US011491621B2

(12) United States Patent
Li et al.

(10) Patent No.: US 11,491,621 B2
(45) Date of Patent: Nov. 8, 2022

(54) SAFETY RACK REGULATING DEVICE FOR NAILING GUNS

(71) Applicant: Zhejiang Rongpeng Air Tools Co., Ltd., Zhejiang (CN)

(72) Inventors: Xiaorong Li, Zhejiang (CN); Fazheng Yang, Zhejiang (CN); Zhonghua Jiang, Zhejiang (CN)

(73) Assignee: Zhejiang Rongpeng Air Tools Co., Ltd., Zhejiang (CN)

( * ) Notice: Subject to any disclaimer, the term of this patent is extended or adjusted under 35 U.S.C. 154(b) by 560 days.

(21) Appl. No.: 16/529,734

(22) Filed: Aug. 1, 2019

(65) Prior Publication Data

US 2021/0031346 A1 Feb. 4, 2021

(51) Int. Cl.
*B25C 1/00* (2006.01)

(52) U.S. Cl.
CPC ..... *B25C 1/008* (2013.01)

(58) Field of Classification Search
CPC ..... B25C 1/008
See application file for complete search history.

(56) References Cited

U.S. PATENT DOCUMENTS

| | | | | |
|---|---|---|---|---|
| 2017/0203424 | A1* | 7/2017 | Vettoretti | B25C 1/143 |
| 2020/0238493 | A1* | 7/2020 | Wierzchon | B25C 1/047 |
| 2021/0008701 | A1* | 1/2021 | Tan | B25C 1/047 |
| 2021/0031346 | A1* | 2/2021 | Li | B25C 1/008 |

* cited by examiner

*Primary Examiner* — Praachi M Pathak

(57) ABSTRACT

A safety rack regulating device for nailing guns comprises a regulating base, a guide slot located in the left part of regulating base, and a safety rack located in the guide slot. The left end of safety rack is extended out of the regulating base and provided with a safety head. A square groove is located in the left part of the regulating base. A clamping cap is located in the regulating base, the clamping cap seals the opening of square groove. The enclosure between the clamping cap and inner wall of regulating base forms a guide hole. A suited adjusting bolt is located in the guide hole. A transverse punch hole is located in the center of the adjusting bolt. A regulation hole corresponding to the position of adjusting bolt is located in the outer wall of the regulating base.

5 Claims, 5 Drawing Sheets

SAFETY RACK REGULATING DEVICE FOR NAILING GUNS

BACKGROUND OF INVENTION

1. Field of the Invention

The present invention relates generally to a safety rack regulating device for nailing guns.

2. Description of Related Art

The nailing gun is a device for nailing, mainly for building and decoration industries. The safety rack is a component which can change the nailing depth by changing its position, the position of the safety rack can be changed by the safety rack regulating device, and the worker only needs to rotate the regulating roller of safety rack regulating device. The regulating roller of a conventional safety rack regulating device is moved as the screw thread drives the safety rack, it is free of a stop device, so the regulating roller is very likely to rotate automatically when it receives the counterforce of screw thread, so that the position of safety rack deviates, the safety rack localization accuracy cannot be guaranteed.

SUMMARY OF THE INVENTION

The purpose of the present invention is to overcome the deficiencies in the existing technology to provide a leak-proof plunger pump.

In order to solve the above problems, the technical scheme of the present invention is described below:

A safety rack regulating device for nailing guns comprising: a regulating base, a guide slot located in a left part of the regulating base, and a safety rack located in the guide slot; a left end of the safety rack extended out of the regulating base and having a safety head, wherein the left part of the regulating base includes a square groove disposed therein; a clamping cap is located in the regulating base; the clamping cap seals the opening of square groove; the enclosure between the clamping cap and inner wall of regulating base forms a guide hole; a suited adjusting bolt is located in the guide hole; a transverse punch hole is located in the center of the adjusting bolt; a regulation hole corresponding to the position of adjusting bolt is located in the outer wall of the regulating base; the adjusting bolt is connected to a regulating roller by the screw thread on the outer wall, the regulating roller partially extends out of the regulating base through the regulation hole; an on-off lever coaxial with the adjusting bolt is located in the right part of the regulating base; the left end of the on-off lever is provided with a first stop plate, a second stop plate is located outside the right part of on-off lever; a union joint is located in the center of the first stop plate; the union joint penetrates into the transverse punch hole through the right end of transverse punch hole; the right end of safety rack penetrates into the transverse punch hole through the left end of transverse punch hole; the right end of safety rack is connected to the union joint by a buffer pressure spring; the right end of the on-off lever is provided with a resetting device matching the second stop plate; a locating pressure spring opposite to the left sidewall of regulating roller is located in the square groove; the left sidewall of the regulating roller is provided with several V-grooves distributed uniformly in a circle; the right side of the square groove is provided with an opening corresponding to the position of V-groove; the right end of the locating pressure spring is provided with a steel ball, the steel ball is pressed in a V-groove by the spring force of locating pressure spring.

More particularly, wherein the resetting device has a restraining groove located in the regulating base; the left side of the restraining groove is provided with a ring gasket; the right end of the on-off lever penetrates through the inner bore of ring gasket and the restraining groove, and it is provided with a spacing ring; the outside diameter of the ring gasket and the outside diameter of spacing ring are larger than the diameter of restraining groove; there is a return spring between the second stop plate and ring gasket.

More particularly, wherein the outer peripheral surface of the regulating roller is provided with several anti-slip bulges distributed uniformly in a circle.

More particularly, wherein the right end of the safety rack is a chucking head; the width of the chucking head is smaller than the width of safety rack, a first chucking step is formed between the chucking head and safety rack; a second chucking step is formed between the union joint and the first stop plate; the left end of the buffer pressure spring is fitted over the chucking head and stuck in the first chucking step, the right end of buffer pressure spring is fitted over the union joint and stuck in the second chucking step.

More particularly, wherein the regulating base is fixed to the clamping cap by a screw.

Benefits of the Present Invention:

In comparison to the existing technology, when the regulating roller of the safety rack regulating device of the nailing gun of this structure is rotated for an angle, the steel ball moves from one V-groove into an adjacent V-groove, the worker can feel an obvious frustration, so that the worker can know the angle of rotation, the regulation awareness is clearer, the hand feeling is better, and the frustration formed by the spring force applied by the locating pressure spring to the steel ball can form an effective resistance to limit the rotation of the regulating roller. When the regulating roller is not rotated anymore, the steel ball addresses the regulating roller immediately, so as to avoid autorotation of regulating roller shifting the position of safety rack, the positioning accuracy is guaranteed.

DETAILED DESCRIPTION OF THE INVENTION

Figure 1:
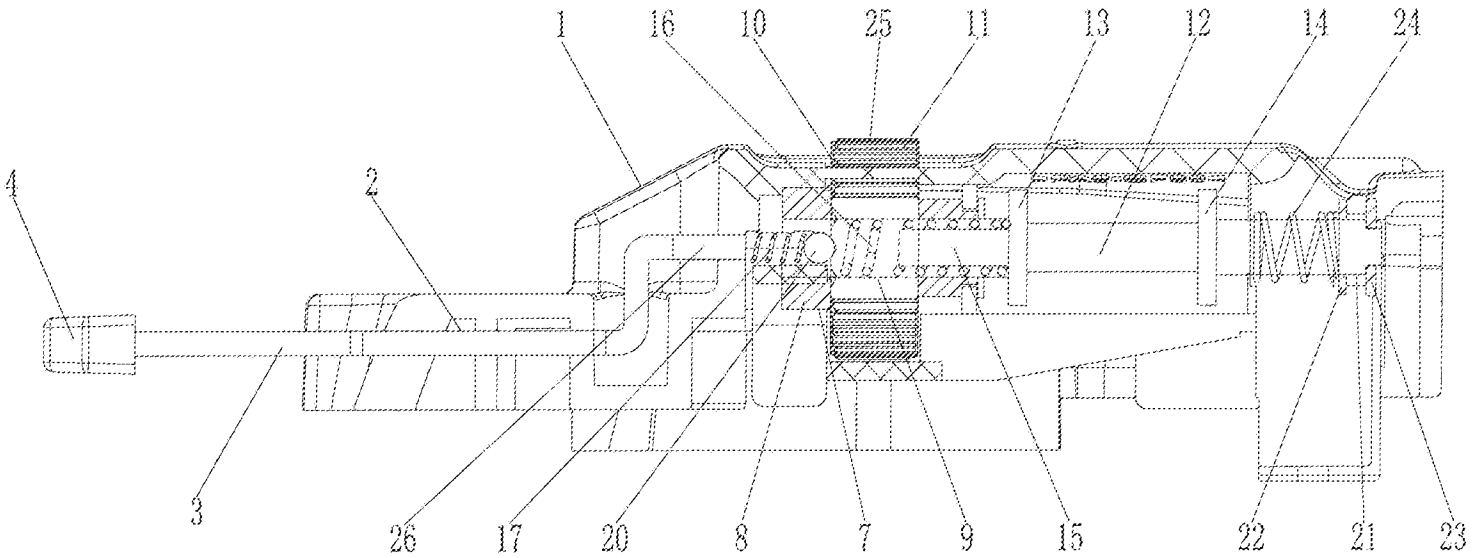
FIG. 1 is a sectional view of safety rack regulating device for nailing guns of the present invention.
Figure 2:
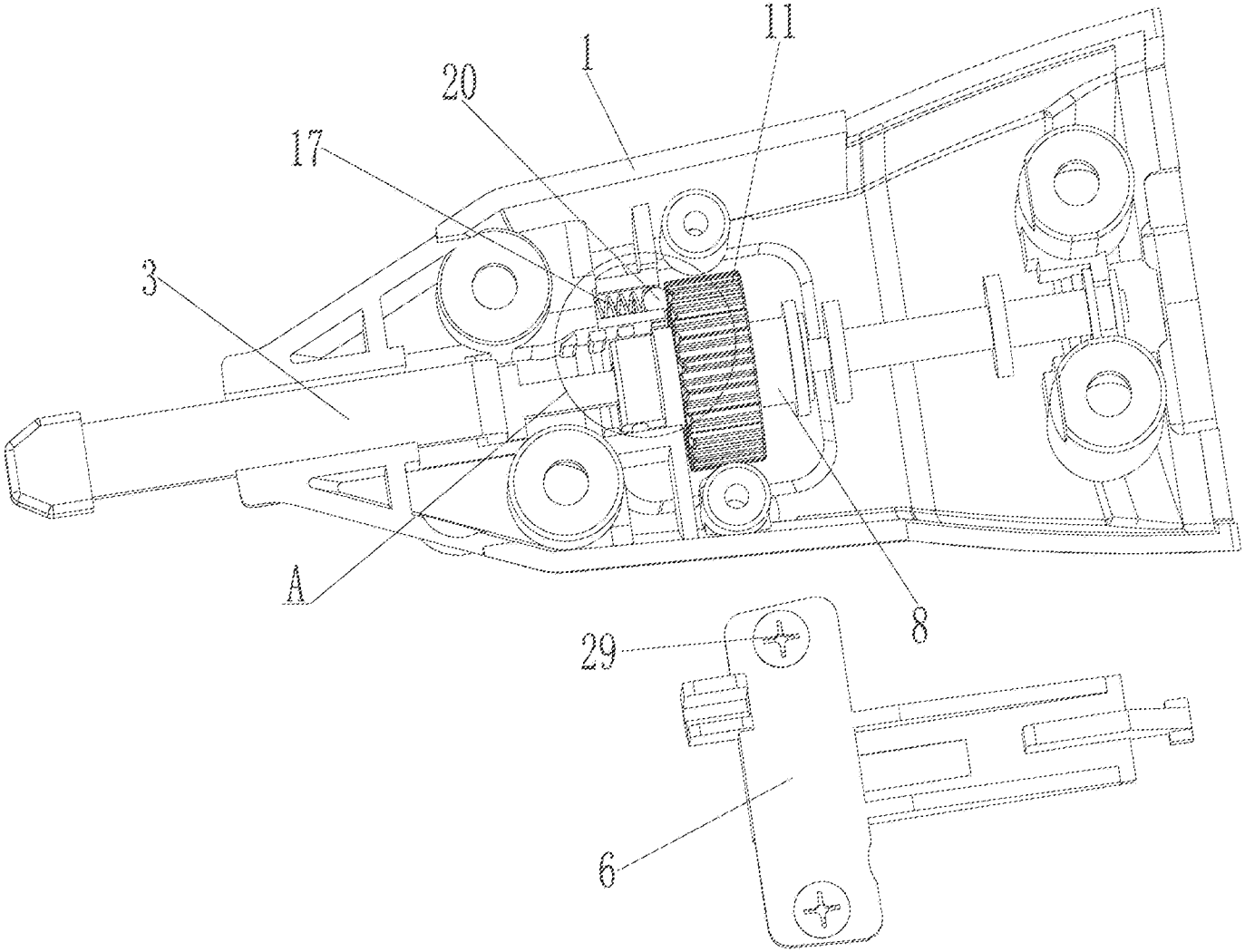
FIG. 2 is a structural representation of safety rack regulating device for nailing guns of the present invention.
Figure 3:
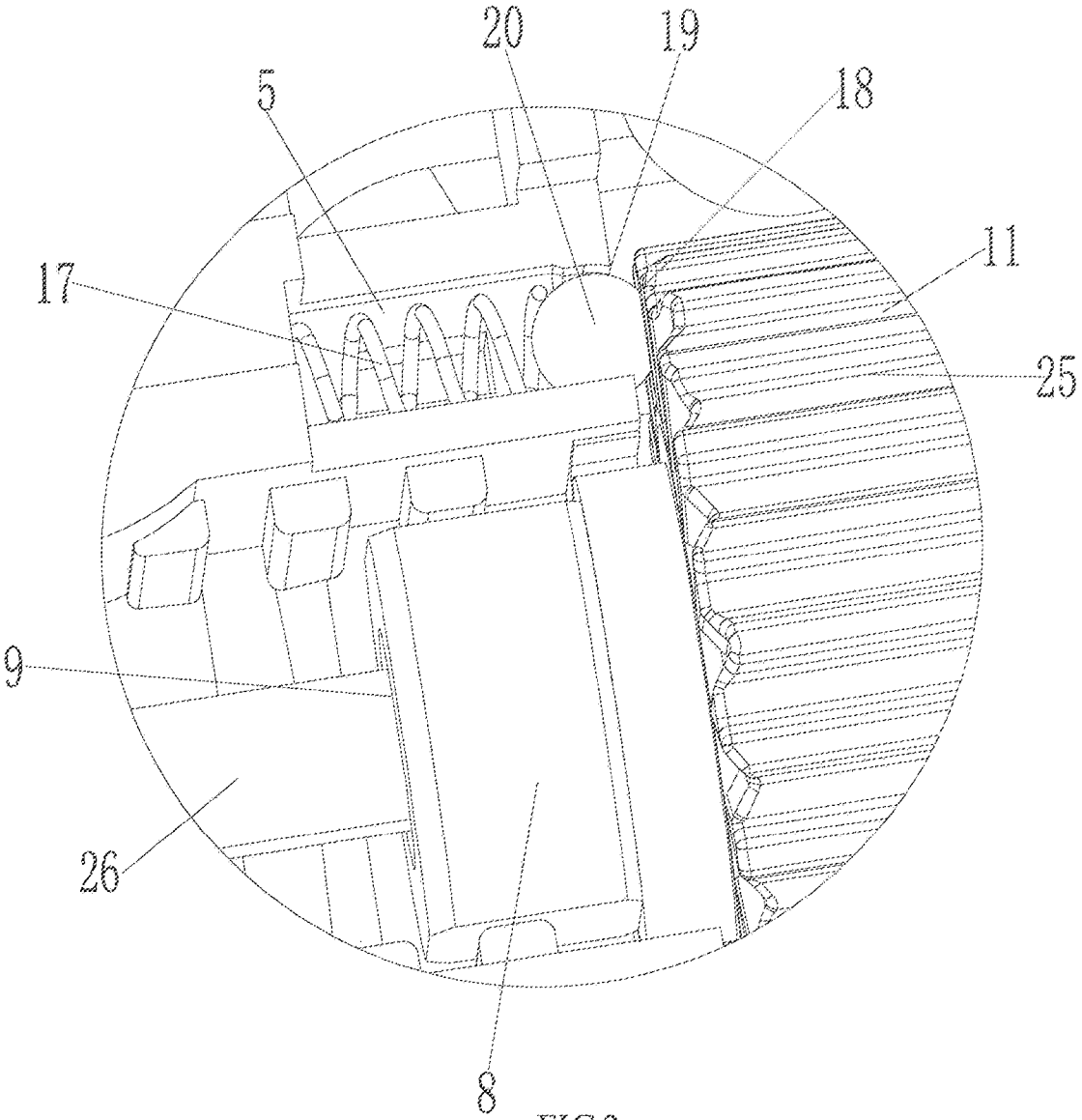
FIG. 3 is an enlarged view of Part A of FIG. 2.
Figure 4:
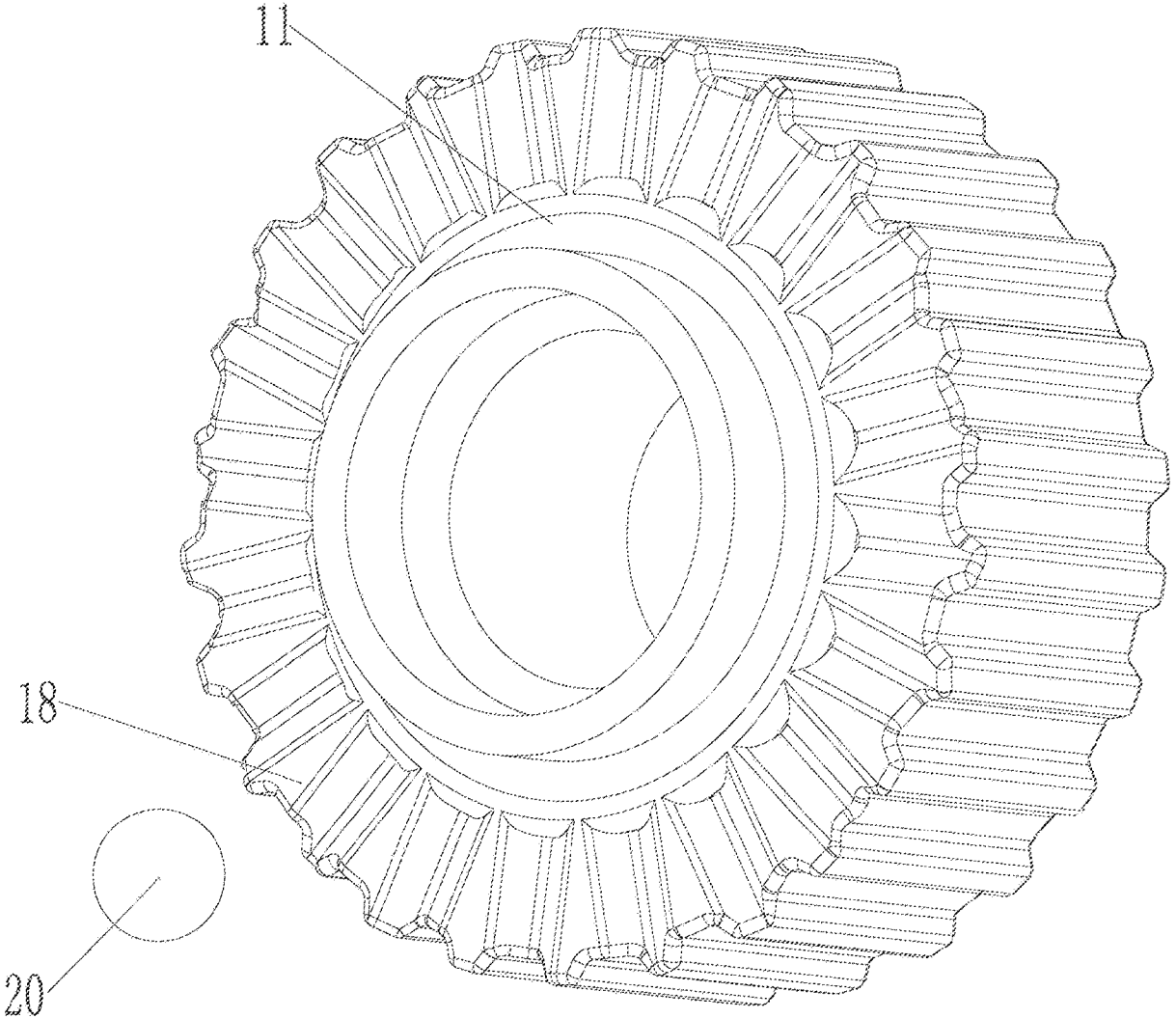
FIG. 4 is a structural representation of coordination between steel ball and regulating roller.
Figure 5:
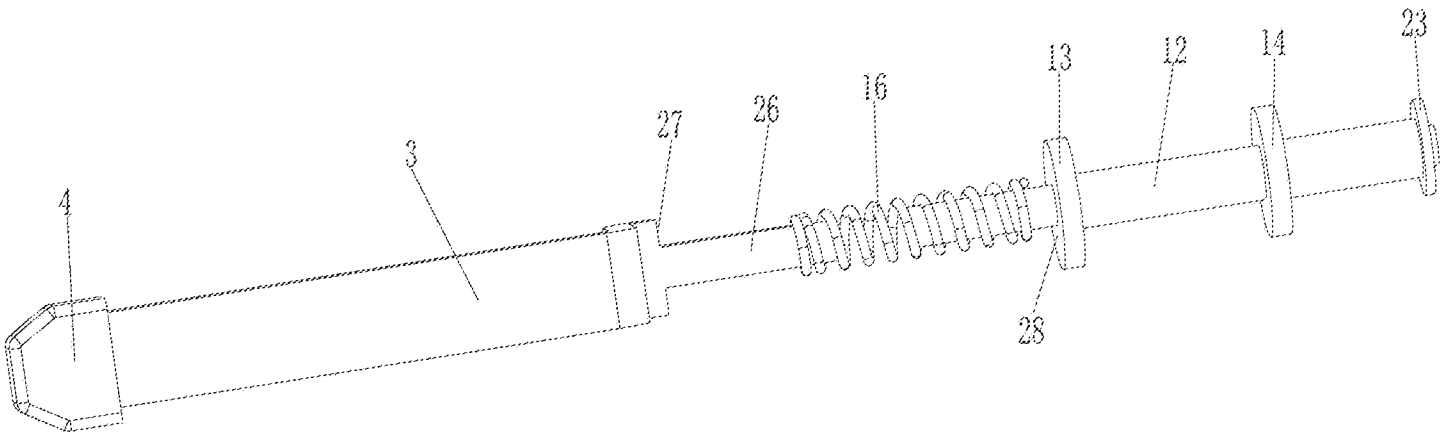
FIG. 5 is a structural representation of connection between safety rack and on-off lever.

FIGS. 1~5 show a safety rack regulating device for nailing guns, which comprises a regulating base 1, a guide slot 2 located in the left part of regulating base 1, and a safety rack 3 located in the guide slot 2. The left end of safety rack 3 is extended out of the regulating base 1 and provided with a safety head 4. A square groove 5 is located in the left part of the regulating base 1; a clamping cap 6 is located in the regulating base 1, the clamping cap 6 seals the opening of square groove 5; the enclosure between the clamping cap 6 and regulating base 1 forms a guide hole 7; a suited adjusting bolt 8 is located in the guide hole 7; a transverse punch hole 9 is located in the center of the adjusting bolt 8; a regulation hole 10 corresponding to the position of adjusting bolt 8 is located in the outer wall of the regulating base 1; the adjusting bolt 8 is connected to a regulating roller 11 through the thread on the outer wall, the regulating roller 11 partially extends out of the regulating base 1 through the regulation hole 10; an on-off lever 12 coaxial with adjusting bolt 8 is located in the right part of the regulating base 1; the left end of the on-off lever 12 is provided with a first stop plate 13, the right part of on-off lever 12 is provided with a second stop plate 14; a union joint 15 is located in the center of the first stop plate 13; the union joint 15 penetrates into the transverse punch hole 9 through the right end of transverse punch hole 9, the right end of safety rack 3 penetrates into the transverse punch hole 9 through the left end of transverse punch hole 9, the right end of safety rack 3 and union joint 15 are connected by a buffer pressure spring 16; the right end of the on-off lever 12 is provided with a resetting device matching the second stop plate 14; a locating pressure spring 17 opposite to the left sidewall of regulating roller 11 is located in the square groove 5; the left sidewall of the regulating roller 11 is provided with several V-grooves 18 distributed uniformly in a circle; the right side of the square groove 5 is provided with an opening 19 corresponding to the position of V-groove 18; the right end of the locating pressure spring 17 is provided with a steel ball 20, the steel ball 20 is pressed in a V-groove 18 by the spring force of locating pressure spring 17.

The resetting device has a restraining groove 21 located in the regulating base 1; a ring gasket 22 is located on the left side of the restraining groove 21; the right end of the on-off lever 12 penetrates through the inner bore of ring gasket 22 and the restraining groove 21, and it is provided with a spacing ring 23; the outside diameter of the ring gasket 22 and the outside diameter of spacing ring 23 are larger than the diameter of restraining groove 21; there is a return spring 24 between the second stop plate 14 and ring gasket 22.

The outer peripheral surface of the regulating roller 11 is provided with several antislip bulges 25 distributed uniformly in a circle.

The right end of the safety rack 3 is a chucking head 26. The width of the chucking head 26 is smaller than the width of safety rack 3. A first chucking step 27 is formed between chucking head 26 and safety rack 3. A second chucking step 28 is formed between the union joint 15 and the first stop plate 13. The left end of the buffer pressure spring 16 is fitted over the chucking head 26 and stuck in the first chucking step 27. The right end of buffer pressure spring 16 is fitted over the union joint 15 and stuck in the second chucking step 28.

The regulating base 1 is fixed to the clamping cap 6 by a screw 29.

The usage of the present invention is described below:

When in use, the safety head 4 of safety rack 3 adheres to the nailing face, so when the safety rack 3 is compressed, the longer the left part of safety rack extends out of the guide slot 2, the shallower the nail end face penetrates into the nailing face, and the smaller is the nailing depth. On the contrary, the larger the nailing force is, the larger is the nailing depth.

The worker can shift the regulating roller 11 through the part of regulating roller 11 protruding from the regulation hole 10, so as to rotate the regulating roller 11. As the regulating roller 11 and adjusting bolt 8 are connected by screw thread, the adjusting bolt 8 rotates as the regulating roller 11 rotates, the regulating roller 11 has to rotate under the limitation of right and left sidewalls of regulation hole 10, under the limitation of inner wall of guide hole 7, the adjusting bolt 8 converts rotary force into axial movement force, and the adjusting bolt 8 moves rightwards, as the adjusting bolt 8 shifts right, the distance from the chucking step 27 of safety rack to the right end face of adjusting bolt 8 is increased, when the safety rack is pressed for nailing, the more the safety rack draws back, the larger is the nailing depth, otherwise the smaller is the nailing depth.

When the regulating roller 11 is rotated for an angle, the steel ball 20 moves from one V-groove 18 into an adjacent V-groove 18, the worker can feel an obvious frustration, so that the worker can know the angle of rotation, the regulation awareness is clearer, the hand feeling is better, and the frustration formed by the spring force applied by the locating pressure spring 17 to the steel ball 20 can form an effective resistance to limit the rotation of the regulating roller 11. When the regulating roller 11 is not rotated anymore, the steel ball 20 addresses the regulating roller 11 immediately, so as to avoid autorotation of regulating roller 11 shifting the position of safety rack 3, the positioning accuracy is guaranteed to the maximum extent.

The resetting device has a restraining groove 21 located in the regulating base 1, the left side of restraining groove 21 is provided with a ring gasket 22, the right end of on-off lever 12 penetrates through the inner bore of ring gasket 22 and restraining groove 21, and it is provided with a spacing ring 23. The outside diameter of ring gasket 22 and the outside diameter of spacing ring 23 are larger than the diameter of restraining groove 21. There is a return spring 24 between the second stop plate 14 and ring gasket 22. When the on-off lever 12 is pushed rightwards by the buffer pressure spring 16, the second stop plate 14 compresses the return spring 24, the return spring 24 generates elasticity. When the buffer pressure spring 16 shifts left, the spring force of return spring 24 helps the on-off lever 12 reset.

The outer peripheral surface of regulating roller 11 is provided with several antislip bulges 25 distributed uniformly in a circle, the antislip bulges 25 can increase the friction between hand and regulating roller 11 effectively, more favorable for the worker to apply a force to the regulating roller 11, so as to avoid slippage when the worker is rotating the regulating roller 11.

The right end of safety rack 3 is a chucking head 26. The width of chucking head 26 is smaller than the width of safety rack 3. A first chucking step 27 is formed between chucking head 26 and safety rack 3. A second chucking step 28 is formed between the union joint 15 and the first stop plate 13. The left end of the buffer pressure spring 16 adheres to the outside of chucking head 26 and it is stuck in the first chucking step 27. The right end of buffer pressure spring 16 is fitted over the union joint 15 and stuck in the second chucking step 28. The fixing mode of buffer pressure spring 16 is favorable for assembly and disassembly, and for changing the damaged buffer pressure spring 16.

The clamping cap 6 prevents the rolling steel ball 20 from departing from the square groove 5 and extrudes the locating pressure spring 17 from the square groove 5, and the regulating base 1 is fixed to the clamping cap 6 by a screw 29, favorable for the assembly and disassembly of clamping cap 6, and for changing the locating pressure spring 17 and steel ball 20.

We claim:

1. A safety rack regulating device for nailing guns comprising:

a regulating base, a guide slot located in a left part of the regulating base, and a safety rack located in the guide slot; a left end of the safety rack extended out of the regulating base and having a safety head, wherein the left part of the regulating base includes a square groove disposed therein; a clamping cap is located in the regulating base; the clamping cap seals an opening of the square groove; an enclosure between the clamping cap and an inner wall of the regulating base forms a guide hole; a adjusting bolt is located in a guide hole; a transverse punch hole is located in the center of the adjusting bolt; a regulation hole corresponding to the adjusting bolt is located in the outer wall of the regulating base; the adjusting bolt is connected to a regulating roller by a screw thread on an outer wall, the regulating roller partially extends out of the regulating base through the regulation hole; an on-off lever coaxial with the adjusting bolt is located in a right part of the regulating base; a left end of the on-off lever is provided with a first stop plate, a second stop plate is located outside a right part of the on-off lever, a union joint is located in the center of the first stop plate; the union joint penetrates into the transverse punch hole through a right end of the transverse punch hole; a right end of the safety rack penetrates into the transverse punch hole through the left end of transverse punch hole; the right end of safety rack is connected to the union joint by a buffer pressure spring; the right end of the on-off lever is provided with a resetting device matching the second stop plate; a locating pressure spring opposite to a left sidewall of the regulating roller is located in the square groove; the left sidewall of the regulating roller is provided with a plurality of V-grooves distributed uniformly in a circle; the right side of the square groove is provided with an opening corresponding to the position of the plurality of V-grooves; a right end of the locating pressure spring is provided with a steel ball, the steel ball is pressed in one of the plurality of V-grooves by a spring force of the locating pressure spring.

2. The safety rack regulating device for nailing guns defined in claim 1, wherein the resetting device has a restraining groove located in the regulating base; a left side of the restraining groove is provided with a ring gasket; a right end of the on-off lever penetrates through an inner bore of the ring gasket and the restraining groove, and the restraining groove includes a spacing ring disposed thereon; the outside diameter of the ring gasket and the outside diameter of the spacing ring are larger than the diameter of restraining groove; a return spring is provided between the second stop plate and the ring gasket.

3. The safety rack regulating device for nailing guns defined in claim 1, wherein the outer peripheral surface of the regulating roller is provided with several anti-slip bulges distributed uniformly in a circle.

4. The safety rack regulating device for nailing guns defined in claim 1, wherein the right end of the safety rack is a chucking head; the width of the chucking head is smaller than the width of the safety rack, a first chucking step is formed between the chucking head and the safety rack; a second chucking step is formed between the union joint and the first stop plate; a left end of the buffer pressure spring is fitted over the chucking head and stuck in the first chucking step, the right end of the buffer pressure spring is fitted over the union joint and stuck in the second chucking step.

5. The safety rack regulating device for nailing guns defined in claim 1, wherein the regulating base is fixed to the clamping cap by a screw.

* * * * *